United States Patent [19]

Cann

[11] 4,268,291

[45] May 19, 1981

[54] SERIES COMPRESSOR REFRIGERATION CIRCUIT WITH LIQUID QUENCH AND COMPRESSOR BY-PASS

[75] Inventor: Peter L. Cann, Canastota, N.Y.

[73] Assignee: Carrier Corporation, Syracuse, N.Y.

[21] Appl. No.: 88,259

[22] Filed: Oct. 25, 1979

[51] Int. Cl.[3] ..... F25B 5/00

[52] U.S. Cl. ..... 62/117; 62/198; 62/224; 62/510

[58] Field of Search ..... 62/198, 510, 224, 117

[56] References Cited

U.S. PATENT DOCUMENTS

| | | | |
|---|---|---|---|
| 2,024,323 | 12/1935 | Wyld | 62/115 |
| 2,344,214 | 3/1944 | Pownall | 62/115 |
| 2,938,361 | 5/1960 | McNatt | 62/117 |
| 3,092,976 | 6/1963 | Hashemi-Tafreshi | 62/117 |
| 3,151,469 | 10/1964 | Quick | 62/169 |
| 3,184,926 | 5/1965 | Blake | 62/155 |
| 3,238,738 | 3/1966 | Webber | 62/196 |
| 3,759,052 | 9/1973 | Inoue | 62/115 |
| 3,954,430 | 5/1976 | Curtis et al. | 62/510 |

*Primary Examiner*—Ronald C. Capossela

*Attorney, Agent, or Firm*—J. Raymond Curtin; Robert P. Hayter

[57] ABSTRACT

Apparatus and method for operating a series compression refrigeration system are disclosed. A by-pass for circuiting refrigerant around one compressor when the compressor is not operating is provided. Additionally, a quench conduit conducts liquid refrigerant from a common line to provide a liquid refrigerant quench of the gaseous refrigerant between compressors. A control device is provided for regulating the flow of liquid refrigerant through the quench conduit.

5 Claims, 1 Drawing Figure

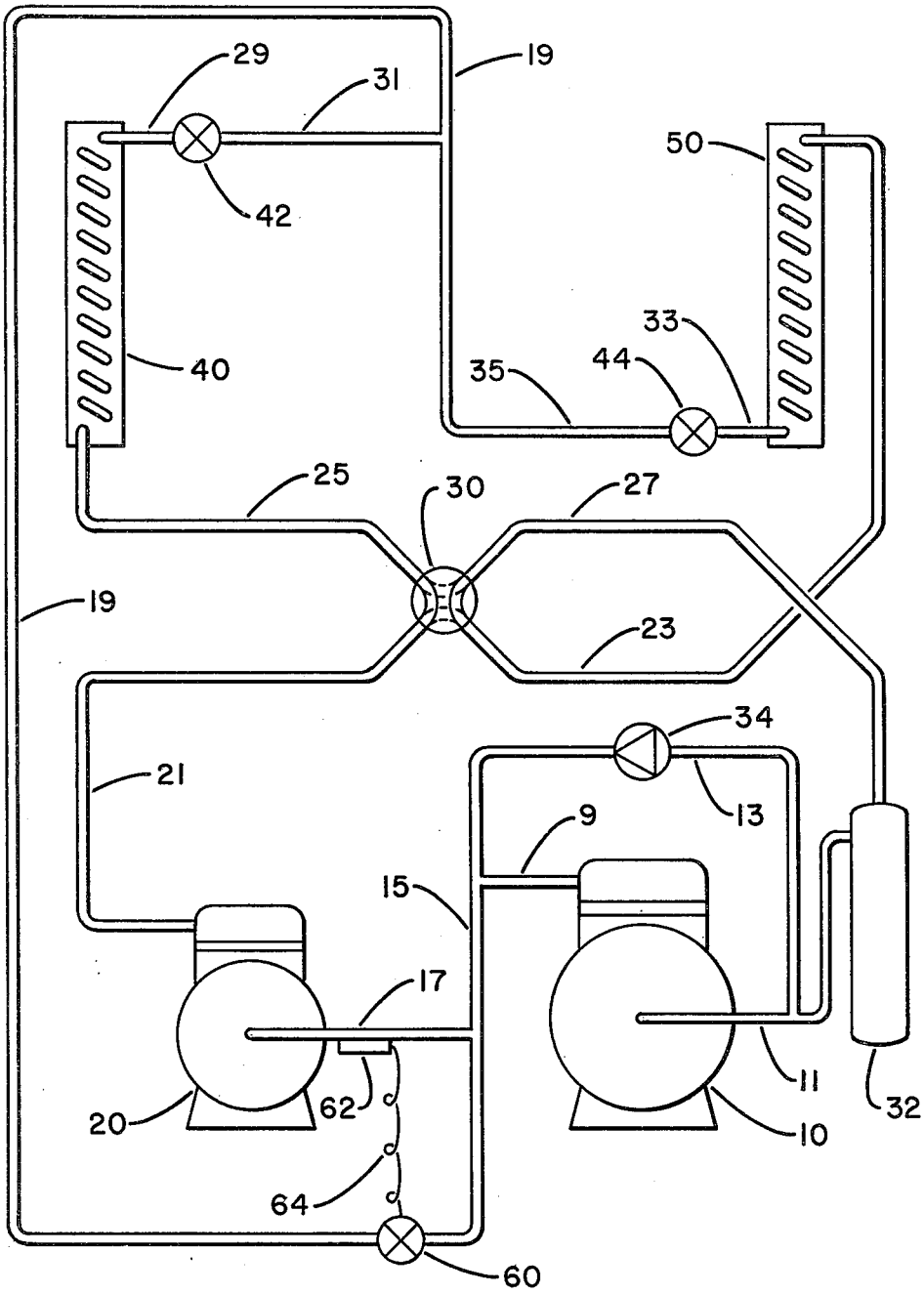
29
31
19
50
42
33
40
44
35
25
30
27
19
23
34
21
13
9
15
17
11
32
20
62
10
64
60

SERIES COMPRESSOR REFRIGERATION CIRCUIT WITH LIQUID QUENCH AND COMPRESSOR BY-PASS

BACKGROUND OF THE INVENTION

1. Field of the Invention

The present invention relates to a refrigeration circuit having multiple compressors arranged in series. More particularly, the present invention concerns a by-pass arrangement for circuiting refrigerant around a compressor and an apparatus for providing a liquid refrigerant quench to cool gaseous refrigerant between the compressors.

2. Description of the Prior Art

In a typical vapor compression refrigeration system various components such as a compressor, condenser, evaporator and expansion device are arranged to transfer heat energy between a fluid in heat transfer relation with the evaporator and a fluid in heat transfer relation with the condenser. In a heat pump system an outdoor coil and indoor coil are located such that the compressor, through a reversing valve, may direct hot gaseous refrigerant to either coil acting as a condenser. The other coil then acts as an evaporator such that depending upon the position of the reversing valve, heat energy is rejected or absorbed in both the indoor coil or the outdoor coil. In the heating mode of operation, heat is rejected in the indoor coil acting as a condenser and heat is absorbed in the outdoor coil acting as an evaporator. The reverse is true in the cooling mode of operation wherein the heat is rejected in the outdoor coil acting as a condenser and the heat is absorbed in the indoor coil acting as an evaporator.

It has been found that in air source heat pump applications that the capacity of the heat pump to provide heat energy diminishes as the ambient air temperature drops. Consequently, as the heating load is increasing, the capability of the heat pump to supply heat energy decreases. Many attempts have been made to increase the heating capacity of heat pump system at lower temperatures. One of these methods is by providing two compressors in series such that the heating capacity of the refrigeration circuit may be substantially increased at lower ambient temperatures.

When two compressors are placed in series such that there is a low stage compressor having a compressor discharge line connected to the suction line of a high stage compressor several potential problems are created. One of these problems is how to operate the system with only one compressor when ambient conditions are such that it is only necessary to operate one compressor. Another problem is how to avoid excessive refrigeration temperatures which may result in degradation of the refrigerant and/or oil mixed with the refrigerant. This present application concerns a method and apparatus of addressing these two problems.

A by-pass line is described herein for circuiting refrigerant around a low stage compressor to the suction line of a high stage compressor. This line has a check valve located therein such that when the low stage compressor is operating refrigerant may not flow from the low stage compressor discharge line to the low stage compressor suction line.

This application also discloses a quench conduit for conducting liquid refrigerant from the heat exchanger serving as the condenser to the high stage compressor suction line. This quench conduit has a control device such as a thermal expansion valve for regulating the flow of liquid refrigerant therethrough. This expansion valve meters liquid refrigerant into the high stage compressor suction line such that the liquid refrigerant flashes cooling the mixture of gaseous refrigerant being supplied to the high stage compressor.

SUMMARY OF THE INVENTION

It is an object of the present invention to provide a refrigeration system having series compressors.

It is a further object of the present invention to by-pass the low stage compressor under the appropriate operating conditions with a minimum of valving and piping.

It is a further object of the present invention to provide a liquid refrigerant quench to cool the gaseous refrigerant entering the high stage compressor suction line.

It is another object of the present invention to provide a safe, economical and reliable series compression refrigeration system.

These and other objects of the present invention are achieved by utilizing a vapor compression refrigeration circuit having a low stage compressor, a high stage compressor, a reversing valve and indoor and outdoor heat exchangers. The by-pass line is provided such that when the high stage compressor is operated without the low stage compressor being operated gaseous refrigerant may be drawn from the low stage compressor suction line directly to the high stage compressor suction line avoiding the low stage compressor. A check valve is mounted in this line to prevent backflow of refrigerant when the low stage compressor is operated. Additionally, the indoor heat exchanger and the outdoor heat exchanger each has associated therewith an expansion device. Connecting the expansion devices is a common line to which a quench conduit is connected. This quench conduit supplies liquid refrigerant to the high stage compressor suction line. The flow of refrigerant through the quench conduit is regulated by a thermal expansion valve such that an appropriate amount of liquid refrigerant is provided to cool the gaseous mixture being supplied to the high stage compressor.

BRIEF DESCRIPTION OF THE DRAWING

The FIGURE is a schematic view of a series compression refrigeration system having both a low stage compressor by-pass and a liquid refrigerant quench between compression stages.

DESCRIPTION OF THE PREFERRED EMBODIMENT

The invention as described herein will refer to a residential heat pump system having a low stage compressor and a high stage compressor. It is understood that this invention finds like applicability to refrigeration systems designed solely for heating or cooling or for other applications. This invention also finds applicability to systems having more than two compressors and to systems designed for not only providing air conditioning but for refrigeration and other applications wherein heat energy is transferred.

Additionally, it is to be understood that although the disclosed system does not have a subcooler, it is common to provide a subcooler such that in the heating mode of operation a portion of the liquid refrigerant condensed to give off heat to the enclosure may be flashed to a gas at the intermediate pressure between the low stage and high stage compressors subcooling the remaining liquid refrigerant. This subcooled liquid refrigerant is then evaporated in the outdoor heat exchanger where, because of the greater temperature differential between the subcooled refrigerant and the ambient air, the overall efficiency of the outdoor heat exchanger improves.

Referring now to the FIGURE, there can be seen a vapor compression refrigeration system having a low stage compressor 10, a high stage compressor 20, four-way or reversing valve 30, indoor heat exchanger 40 and outdoor heat exchanger 50. Low stage compressor 10 receives refrigerant through low stage compressor suction line 11 which is connected to accumulator 32. Low stage compressor 10 discharges refrigerant through low stage compressor discharge line 9 to interconnecting line 15. Interconnecting line 15 is connected to the high stage compressor suction line 17 which delivers refrigerant to the high stage compressor 20. High stage compressor discharge line 21 is connected to four-way valve 30 as is line 27 connecting the four-way valve to the accumulator 32. Line 25 connects the four-way valve to indoor heat exchanger 40 and line 23 connects the four-way valve to the outdoor heat exchanger 50. Line 29 connects indoor heat exchanger 40 to expansion device 42 which is connected by line 31 to common line 35. Common line 35 is likewise connected to expansion device 44 which is connected through line 33 to outdoor heat exchanger 50.

A by-pass of the low stage compressor is provided via line 13, check valve 34 and interconnecting line 15. As can be seen in the figure, line 13 connects low stage compressor suction line 11 to interconnecting line 15. Check valve 34 is mounted in line 13 to regulate the flow of refrigerant therethrough.

Quench conduit 19 connects common line 35 to interconnecting line 15. Thermal expansion valve 60 is mounted to regulate the flow of refrigerant through the quench line. Bulb 62 connected by tube 64 to thermal expansion valve 60 senses the temperature of the gaseous refrigerant entering the high stage compressor through high stage compressor suction line 17. The flow of liquid refrigerant through quench line 19 is regulated as a function of the temperature of the gaseous refrigerant flowing through high stage compressor suction line 17 by controlling the volume flow therethrough with thermal expansion valve 60.

OPERATION

When the need for two stage operation is sensed, both compressors are energized and gaseous refrigerant flows into low stage compressor 10 through low stage compressor suction line 11. This refrigerant is then increased in temperature and pressure and discharged through low stage compressor discharge line 9 to interconnecting tubing 15 to high stage compressor suction line 17.

Consequently, the increased temperature and pressure of the gas discharged by compressor 10 is directed into high stage compressor 20 wherein the temperature and pressure are further increased. Since this double step of increasing the temperature and pressure in both compressors may result in the temperature of the refrigerant and any oil contained therein being sufficiently high for degradation, it is desirable to decrease the temperature of the refrigerant entering the high stage compressor. Additionally, by decreasing the temperature, the mass flow rate may be increased to improve the overall performance of the high stage compressor.

Quench line 19 is connected so that regardless of the mode of operation of the heat pump, liquid refrigerant is supplied thereto. Expansion devices 42 and 44 are shown associated with the heat exchangers. Each of these expansion devices serve to meter refrigerant when flow direction is one way and to allow the refrigerant to flow therethrough without restriction when the direction of flow is in the opposite direction. Consequently, when the unit is in the heating mode, liquid refrigerant supplied from indoor heat exchanger 40 passes through expansion device 42 without restriction and then is metered through expansion device 44 to create a pressure drop. In the cooling mode of operation the opposite occurs with the liquid refrigerant being conducted from outdoor heat exchanger 50 where it has been condensed through expansion device 44 without undergoing a pressure drop and then through expansion device 42 where it is metered to create a pressure drop such that the indoor heat exchanger may act as an evaporator. In either mode of operation, liquid refrigerant flows through common line 35 which is connected to quench line 19. Consequently, regardless of the mode of operation, liquid refrigerant is supplied through quench line 19 to a control device shown as thermal expansion valve 60. This device may be any regulating device which serves to control the flow of refrigerant through quench line 19 and simultaneously to meter said refrigerant such that it undergoes a pressure drop from the high stage compressor discharge pressure to the high stage compressor suction pressure such that this liquid refrigerant flashes to a gas, absorbing its heat of vaporization. By providing a mixture of flashed gaseous refrigerant with the refrigerant discharged from the low stage compressor, the overall gaseous refrigerant temperature entering the high stage compressor is decreased to aid in the overall efficiency of the high stage compressor.

Bulb 62 is located on the high stage compressor suction line such that it senses the temperature or superheat of the gaseous refrigerant entering the high stage compressor. By sensing this temperature thermal expansion valve is regulated to either increase or decrease the flow of liquid refrigerant therethrough for providing the appropriate amount of flash cooling of the gaseous refrigerant entering the high stage compressor.

When the unit senses a need for heating or cooling which can be satisfied with only the operation of the high stage compressor, the low stage compressor is not energized. When the low stage compressor is not energized gaseous refrigerant flows from accumulator 32 into by-pass line 13 through check valve 34 into interconnecting line 15 to high stage compressor line 17 of the high stage compressor. The suction drawn by the high stage compressor is sufficient to cause refrigerant circulation. However, when the low stage compressor is operated, the refrigerant is drawn through the low stage compressor line 11 into the low stage compressor where it is increased in temperature and pressure and then discharged through low stage compressor discharge line 9. Since the pressure of the refrigerant discharged from the low stage compressor is increased there is a tendency to create a backflow through interconnecting line 15 and line 13 back to the compressor suction line 11. Check valve 34 located in by-pass line 13 serves to prevent this backflow.

While the invention has been described in reference to the preferred embodiment it is to be understood by those skilled in the art that modifications and variations can be effected within the spirit and scope of the invention.

I claim:

1. A refrigeration circuit having a low stage compressor with a compressor discharge line and suction line, high stage compressor having a compressor suction line and a discharge line, an interconnecting line connecting the compressor discharge line of the low stage compressor to the compressor suction line of the high stage compressor, an evaporator and a condenser which comprises:

a by-pass conduit connecting the low stage compressor suction line to the interconnecting line such that gaseous refrigeration may by-passs the low stage compressor; and a check valve mounted in the by-pass conduit to prevent flow therethrough from the low stage compressor discharge line to the low stage compressor suction line such that during operation of low stage compressor the low stage compressor discharge line is at a higher pressure than the low stage compressor suction line and the check valve then prevents refrigeration flow through the by-pass conduit and when the low stage compressor is not operating refrigerant may freely flow through the by-pass conduit to the high stage compressor suction line without impediment from the check valve; and a quench conduit connecting the condenser to the interconnecting line for supplying liquid refrigerant thereto; and a control device for regulating the amount of liquid refrigerant flowing through the quench conduit as a function of the temperature of the gaseous refrigerant entering the high stage compressor, said liquid refrigerant flashing to a gas as it is metered through the control device.

2. The apparatus as set forth in claim 1 wherein the control device is a thermal expansion valve and wherein the valve is controlled by a bulb mounted on the high stage compressor suction line to sense the temperature of the gaseous refrigerant entering the high stage compressor.

3. A reversible refrigeration circuit which comprises:

a first heat exchanger;

a second heat exchanger;

an expansion device associated with each heat exchanger;

a common line connecting the expansion devices to each other;

reversing means;

a low stage compressor adapted to receive gaseous refrigerant through the reversing means from the one of said heat exchangers serving as an evaporator, said compressor increasing the temperature and pressure of said gaseous refrigerant;

a high stage compressor adapted to receive gaseous refrigerant from the low stage compressor and to further increase the temperature and pressure of said refrigerant, said refrigerant being discharged through the reversing means to the one of said heat exchangers serving as a condenser;

by-pass means for supplying gaseous refrigerant from the heat exchanger serving as an evaporator to the high stage compressor, said by-pass means including a check valve to prevent backflow therethrough;

a conduit connecting the common line with the high stage compressor such that liquid refrigerant may be conducted thereto; and a control device for regulating flow of liquid refrigerant through the conduit, said liquid refrigerant flashing to a gas to cool the gaseous refrigerant entering the high stage compressor.

4. A method of operating a refrigeration circuit with refrigerant flowing therethrough having a low stage compressor in series with a high stage compressor, a first heat exchanger and a second heat exchanger which comprises the steps of:

detecting the appropriate load conditions for the refrigeration circuit;

energizing either the high stage compressor under partial load conditions or energizing both compressors under larger load conditions;

by-passing refrigerant around the low stage compressor when only the high stage compressor is energized;

conducting liquid refrigerant from the heat exchanger serving as the condenser to the refrigerant inlet of the high stage compressor; and regulating the flow of liquid refrigerant from the condenser to the high stage compressor suction line as a function of the superheat of the gaseous refrigerant entering the high stage compressor, said liquid refrigerant from the condenser flashing to cool the gaseous refrigerant entering the high stage compressor.

5. The method as set forth in claim 4 and further including the step of:

reversing the flow geometry of the refrigerant through the first and second heat exchangers such that either may serve as an evaporator or condenser.

* * * * *